US005490312A

United States Patent [19]

Smith

[11] Patent Number: 5,490,312

[45] Date of Patent: Feb. 13, 1996

[54] RIVET SETTING TOOL

[75] Inventor: Daniel R. Smith, Birmingham, United Kingdom

[73] Assignee: Emhart Inc., Newark, Del.

[21] Appl. No.: 391,401

[22] Filed: Feb. 16, 1995

[30] Foreign Application Priority Data

Feb. 19, 1994 [GB] United Kingdom ..... 9403220

[51] Int. Cl.[6] ..... B21J 15/20

[52] U.S. Cl. ..... 29/243.525; 29/243.523

[58] Field of Search ..... 29/243.521, 243.523, 29/243.524, 243.525

[56] References Cited

U.S. PATENT DOCUMENTS

| | | | |
|---|---|---|---|
| 4,517,820 | 5/1985 | Oefinger | 29/243.525 |
| 4,598,571 | 7/1986 | Oefinger | 29/243.525 |
| 4,648,258 | 3/1987 | Frearson | 29/243.525 |
| 4,704,888 | 11/1987 | Frearson | 29/243.525 |
| 4,878,372 | 11/1989 | Port et al. | 29/243.525 |
| 5,086,551 | 2/1992 | Shamaly et al. | 29/243.525 |

*Primary Examiner*—David Jones
*Attorney, Agent, or Firm*—E. D. Murphy

[57] ABSTRACT

A blind rivet setting tool is provided with a spare set of parts which enables a simple conversion from a short, powerful setting stroke to a longer, less powerful stroke.

4 Claims, 2 Drawing Sheets

RIVET SETTING TOOL

This invention is concerned with blind rivet setting tools.

BACKGROUND TO THE INVENTION

A conventional blind rivet comprises a rivet body and a mandrel extending through the rivet body, and is set by inserting the rivet body in a work piece, applying a tool to the blind rivet to engage the mandrel and a head of the rivet body and then causing the tool to withdraw the mandrel while restraining the rivet body by the engagement with the head, thus to cause deformation of the rivet body to set the rivet.

The force required to set a rivet, and the distance which the mandrel needs to be pulled to set the rivet—varies from one rivet to another. High strength rivets require high setting loads and can normally be set with a comparatively short stroke: longer, smaller diameter rivets or rivets adapted to split upon setting require a longer stroke but can normally be set with a lower setting load.

It is often the case that a user of rivets will wish to change from using one type of rivet to another, and if the change is one which requires a change from a shorter, more powerful stroke to a longer, less powerful stroke, the user will need to use a second tool.

An alternative, which is generally regarded as bad practice, is to use a shorter stroke tool to perform two pulling operations to set the rivet, which as well as tending to give unreliable setting of the rivet is time consuming.

Rivet setting tools are comparatively expensive, and it would be advantageous to be able to adapt a rivet setting tool to perform either a shorter more powerful stroke or a longer, less powerful stroke.

It is one of the objects of the present invention to provide a blind rivet setting tool which is convertible between operation with a shorter, more powerful, stroke and a longer, less powerful, stroke.

BRIEF STATEMENT OF THE INVENTION

The present invention provides a blind rivet setting tool which is convertible between operation with a shorter, more powerful stroke and a longer, less powerful stroke comprising:

- a tool body comprising a supply orifice and a bore into which said orifice opens
- means for supplying hydraulic fluid under pressure through said orifice
- a first head member closing a forward end of said bore and having an axial passage therethrough and provided with a forward end face
- a second head member closing a rearward end of said bore and having an axial exit passage therethrough
- a piston chamber formed in the bore between said two head portions
- an outer barrel attached to said tool body
- a collet head slidably mounted in said outer barrel
- said tool also comprising two sets of parts, a first set, for such shorter stroke operation, comprising
  - a piston rod having a piston which fits into said tool body bore and comprising a forward portion adapted to be slidably mounted in the axial passage of the first head member and a rearward portion adapted to be slidably mounted in the axial exit passage of the second head member
  - an extension member comprising a rear end portion adapted to be secured to the forward end portion of the piston rod, and a forward end portion adapted to be secured to the collet head,
  - the arrangement being such that when the first set of parts is assembled in the tool and the tool is operated, hydraulic fluid is admitted through the supply orifice into said bore in front of the piston which is then caused to perform an operating stroke whose length is determined by the distance between the rear end portion of the extension member and said forward end face of the first head member
- and a second set of parts for longer stroke operation comprising
  - an extension collar adapted to be secured to the tool body between the tool body and the second head member and having an axial bore which extends the bore in the tool body
  - a sleeve adapted to fit into said bore of said tool body and to extend between the first head member and the extension collar
  - a piston rod bearing a piston which fits into the sleeve, said rod comprising a forward portion adapted to be slidably mounted in the axial passage of said first head member and a rearward portion adapted to be slidably mounted in said axial exit passage of the second head member
  - an extension member comprising a rear end portion adapted to be secured to the forward end portion of the piston rod and a forward end portion adapted to be secured to the collet head
  - the arrangement being such that when the second set of parts is assembled in the tool and the tool is operated, hydraulic fluid is admitted through the supply orifice into the sleeve in front of the piston which is then caused to perform an operating stroke whose length is determined by the distance between the rear end portion of the extension member and said forward end face of the first head member
  - the product of the stroke of the piston and the area of the piston exposed to hydraulic pressure being substantially equal in the tool assembled with either set of parts.

There will now be described with reference to the accompanying drawings, a blind rivet setting tool embodying the invention.

In the drawings,

FIG. 1 shows a blind rivet setting tool assembled with a first set of parts to give a shorter stroke FIG. 2 shows a blind rivet setting tool assembled with a second set of parts to give a longer stroke

DESCRIPTION OF THE PREFERRED EMBODIMENT

Figure 1:
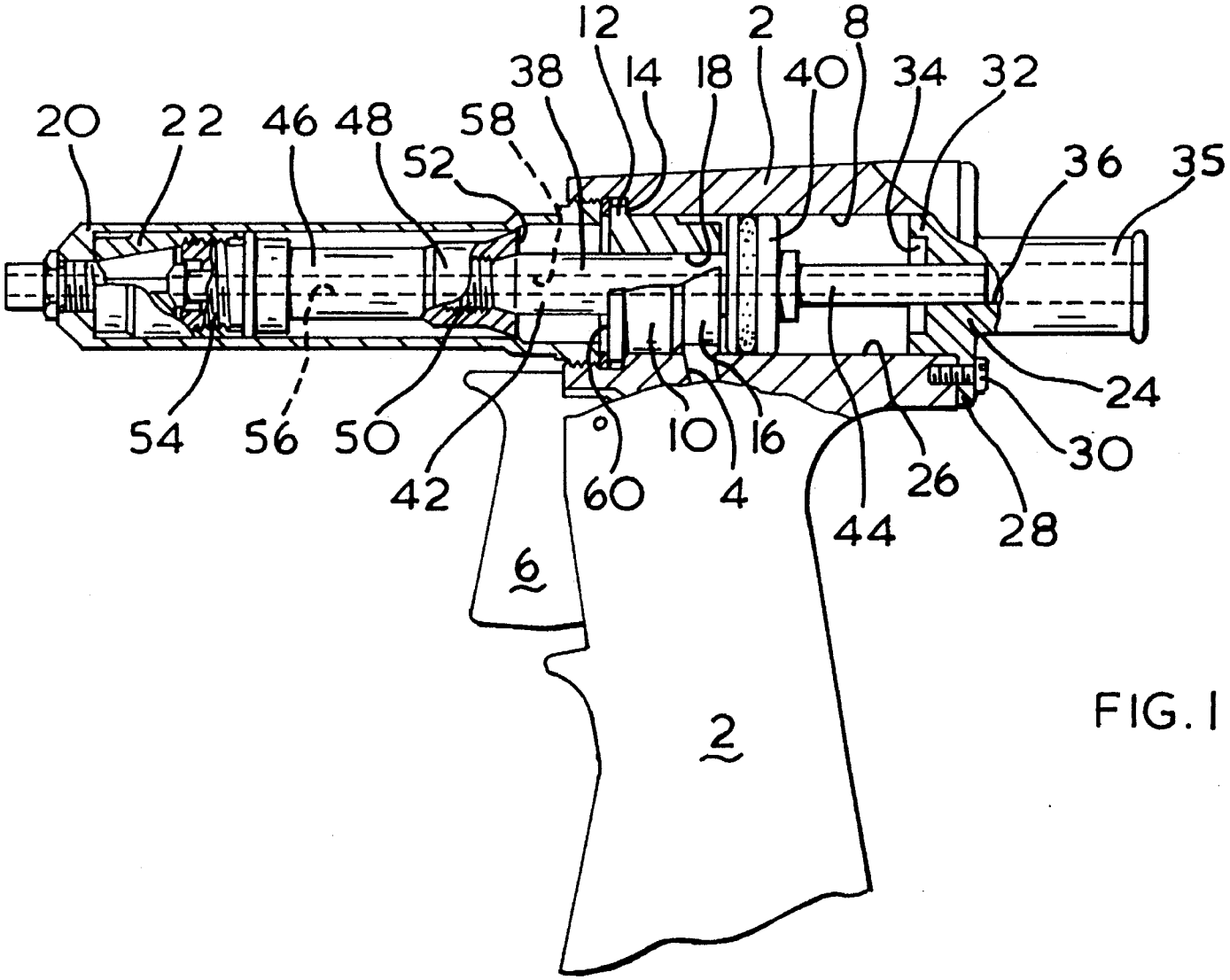

The rivet setting tool comprises a tool body 2 in which are mounted means for supplying hydraulic pressure through a supply orifice 4 in the body. The means for supplying hydraulic pressure are not shown, but are conventional comprising a pneumatically operated intensifier and a piston and cylinder device operated by the intensifier and adapted to provide a supply of hydraulic fluid under pressure through the orifice 4 when a trigger 6 is operated to cause a setting stroke of the tool. A return stroke of the tool is effected by pneumatic pressure created by the setting stroke.

The tool body comprises an axial bore 8 into which the orifice 4 opens. A first head member 10 fits into the bore 8 closing a forward end of the bore 8. The first head member 10 comprises a flange 12 which abuts against a shoulder 14 of the tool body, and a slightly reduced end portion 16 which is positioned opposite the orifice 4. An axial passage 18 extends centrally through the head member 10.

The outer barrel 20 is screwed into a forward end of the body 2 and holds the first head member 10 in position. A collet head 22 of conventional construction is slidably mounted in the outer barrel 20.

A second head member 24 closes a rearward end of the bore 8 to form a piston chamber 26. The second head member comprises a central boss 32 which fits into the bore 8 and comprises a recess 34, and an outwardly extending flange 28 which abuts against an end face of the body 2 and is secured to it by screws 30. A rearwardly extending tubular portion 35 is adapted to receive a mandrel collector or deflecting device—an axial exit passage 36 extends through the head member 24.

The first set of parts, which is assembled in the tool for operation of the tool with a shorter, more powerful stroke comprises a piston rod 38 bearing a piston 40 which fits into the bore 8. The rod 38 comprises a forward portion 42 which is adapted to be slidably mounted in the bore 18 of the first head member 10, and a rearward portion 44 which is adapted to be slidably mounted in the exit passage 36 of the second head member.

The first set of parts also comprises an extension member 46 comprising a rear end portion 48 which is screwed on to a threaded end portion 50 of the forward portion 42 of the piston rod 38, and has an annular end face 52. A threaded forward end portion 54 of the extension member 46 is secured to the collet head 22 by being threaded into a rearward end portion of the collet head 22.

Aligned axial passages 56 in the extension member 46 and 58 in the piston rod 38 allow, when the tool is in use, for the extraction of broken mandrel stems.

When the tool is in use, the mandrel of a blind rivet assembly is inserted into the collet head 22, and the trigger 6 is operated. This supplies hydraulic fluid under pressure through the orifice 4 from whence it is admitted to the bore 8 in front of the piston 40. This causes rearward movement of the piston 40 and piston rod 38, drawing the collet head 22 rearwards. Jaws in the collet head are caused to close on the rivet mandrel and to draw the mandrel rearwardly, thus to set the rivet: when the mandrel breaks it is ejected through the axial passages 56 and 58. This setting stroke of the tool causes air to be compressed in the bore 8 behind the piston 40, which bore is connected to an air reservoir (not shown). This compressed air effects a return stroke of the tool when the hydraulic pressure is released.

The length of the operating stroke of the piston rod 38 is determined by the distance between the annular end face 52 of the extension member 46 and a forward end face 60 of the first head member 10.

Figure 2:
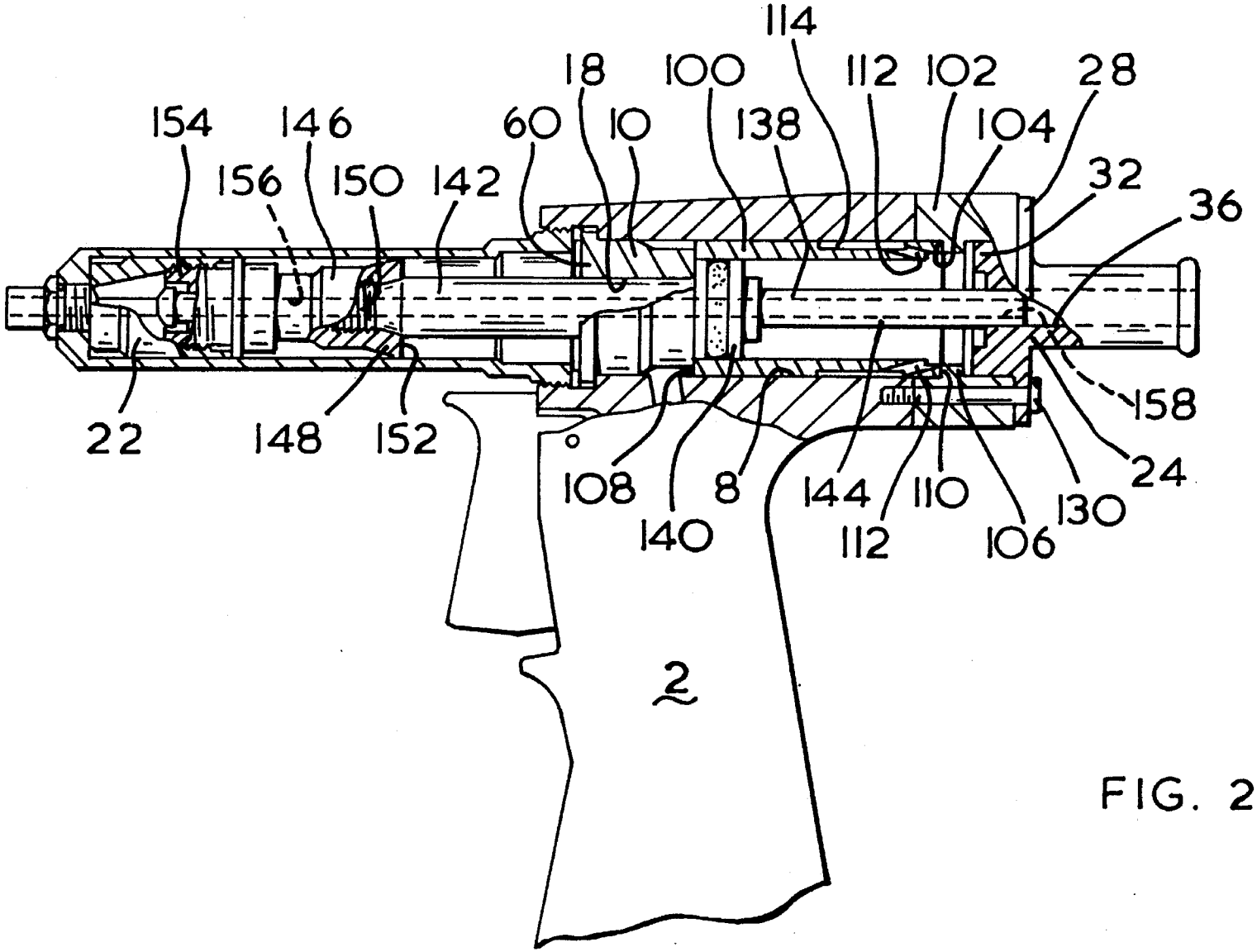

The second set of parts, which is assembled in the tool for operation (see FIG. 2) with a longer, less powerful stroke comprises a piston rod 138 bearing a piston 140. The rod 138 comprises a forward portion 142 which is adapted to be slidably mounted in the bore 18 of the first head member 10, and a rearward portion 144 which is adapted to be slidably mounted in the exit passage 36 of the second head member 24.

It will be noted that the differences between the piston rod 138 of the second set of parts and the piston rod 38 of the first set of parts are that the forward portion 142 is longer than the forward portion 42, the rearward portion 144 is longer than the rearward portion 44, and the piston 140 is of a lesser diameter than the piston 40.

The second set of parts also comprises a sleeve 100 adapted to fit into the bore 8 and an extension collar 102 adapted to be secured to the tool body 2 between the tool body 2 and the second head member 24.

The extension collar 102 comprises a central bore 104 which is of a diameter equal to that of the bore 8 and which is provided with an inwardly extending shoulder 106. When the second set of parts is assembled in the tool, screws 130 extending through the flange 28 of the second head member 24 and holes in the collar 102 secure the collar 102 and the second head member in position, the central boss 32 of the second head member 24 fitting into the bore 104.

The sleeve 100 is assembled into the bore 8 of the tool and has a forward end face 108 which abuts against the first head member 10 and a rearward end face 110 which abuts against the shoulder 106 of the extension collar 102. Bleed orifices 112 towards the rearward end of the sleeve 100 lead from the interior of the sleeve 100 to an annular recess 114 formed on the exterior of the sleeve 100. The recess is connected to the air reservoir (not shown). It will be seen that the piston 140 is a close fit in the sleeve 100.

The second set of parts also comprises an extension member 146 comprising a rear end portion 148 which is screwed onto a threaded end portion 150 of the forward portion 142 of the piston rod 138 and has an annular end face 152. A threaded forward end portion 154 of the extension member 146 is secured to the collet head 22 by being threaded into a rearward end portion of the collet head 22.

It will be seen that the difference between the extension member 146 of the second set of parts and the extension member 46 of the first set of parts is that the member 146 is shorter than the member 46. The lengths of the piston rods and the extension members are such that the distance between the collet head and the forward face of the piston is the same with each set of parts while the distance between the rearward face 52 of the extension member 46 and the forward face 60 of the head member 10 in the first set of parts is shorter than the distance between the rear ward face 152 of the extension member 146 and the forward face 60 of the first head member 10 in the second set of parts.

Aligned axial passages 156 in the extension member 146 and 158 in the piston rod 138 allow, when the tool is in use, for the extraction of broken mandrel stems.

Use of the tool with the second set of parts is similar to that of the tool with the first set of parts in that operation of the trigger 6 admits hydraulic fluid under pressure into the sleeve 100 in front of the piston 140 thus to cause an operating stroke of the tool.

The length of the operating stroke of the piston rod 138 is determined by the distance between the annular end face 152 of the extension member 146 and the forward end face 60 of the first head member 10. The relative sizes of the first set of parts and the second set of parts are such that the product of the stroke of the piston member (38,138) and the area of the piston (40,140) exposed to hydraulic pressure is substantially equal in the tool assembled with either set of parts.

It can be seen that a tool assembled with the first set of parts can simply be converted to a tool assembled with the second set of parts by 1 Removing the second head member 24 by releasing the screws 30.

2 Removing the nose piece 20 by unscrewing it from the tool body 2.

3 Disassembling the collet head 22, the extension member 46 and the piston rod 38 from the first head member 10.

4 Reassembling the collet head 22, the extension member 146 and the piston rod 138 with the first head member 10.

5 Locating the sleeve 100 in the bore 8 and securing the extension collar 102 and the second head member 24 to the tool body by the screws 130.

6 Relocating the first head member 10 together with parts 22,146 and 138 in the tool body 2.

7 Re-securing the nose piece 20 to the tool body 2.

I claim:

1. A blind rivet setting tool which is convertible between operation with a shorter, more powerful stroke and a longer, less powerful stroke comprising:

a tool body comprising a supply orifice and a bore into which said orifice opens means for supplying hydraulic fluid under pressure through said orifice a first head member closing a forward end of said bore and having an axial passage therethrough and provided with a forward end face a second head member closing a rearward end of said bore and having an axial exit passage therethrough a piston chamber formed in the bore between said two head portions an outer barrel attached to said tool body a collet head slidably mounted in said outer barrel said tool also comprising two sets of parts, a first set, for such shorter stroke operation, comprising a piston rod having a piston which fits into said tool body bore and comprising a forward portion adapted to be slidably mounted in the axial passage of the first head member and a rearward portion adapted to be slidably mounted in the axial exit passage of the second head member an extension member comprising a rear end portion adapted to be secured to the forward end portion of the piston rod, and a forward end portion adapted to be secured to the collet head, the arrangement being such that when the first set of parts is assembled in the tool and the tool is operated, hydraulic fluid is admitted through the supply orifice into said bore in front of the piston which is then caused to perform an operating stroke whose length is determined by the distance between the rear end portion of the extension member and said forward end face of the first head member and a second set of parts for longer stroke operation comprising an extension collar adapted to be secured to the tool body between the tool body and the second head member and having an axial bore which extends the bore in the tool body a sleeve adapted to fit into said bore of said tool body and to extend between the first head member and the extension collar a piston rod bearing a piston which fits into the sleeve, said rod comprising a forward portion adapted to be slidably mounted in the axial passage of said first head member and a rearward portion adapted to be slidably mounted in said axial exit passage of the second head member an extension member comprising a rear end portion adapted to be secured to the forward end portion of the piston rod and a forward end portion adapted to be secured to the collet head the arrangement being such that when the second set of parts is assembled in the tool and the tool is operated, hydraulic fluid is admitted through the supply orifice into the sleeve in front of the piston which is then caused to perform an operating stroke whose length is determined by the distance between the rear end portion of the extension member and said forward end face of the first head member the product of the stroke of the piston and the area of the piston exposed to hydraulic pressure being substantially equal in the tool assembled with either set of parts.

2. A tool according to claim 1 wherein in each set of parts an axial bore extends through the extension member and the piston rod.

3. A tool according to claim 1 wherein the extension collar comprises an inwardly extending shoulder adapted to engage an end of the sleeve when the second set of parts is assembled in the tool.

4. A tool according to claim 1 wherein the sleeve is provided with bleed orifices towards its rearward end.

* * * * *